United States Patent [19]

Dobson

[11] Patent Number: 4,762,167

[45] Date of Patent: Aug. 9, 1988

[54] WATER MANAGEMENT SYSTEM

[75] Inventor: Thomas R. Dobson, Shillington, Pa.

[73] Assignee: Tricorn, Inc., Shillington, Pa.

[21] Appl. No.: 932,604

[22] Filed: Nov. 20, 1986

[51] Int. Cl.[4] ..... F28F 7/00; G01F 15/04; G01D 13/02

[52] U.S. Cl. ..... 165/11.1; 116/276; 116/DIG. 41; 116/335; 73/118.1

[58] Field of Search ..... 165/11.1; 116/DIG. 41, 116/206, 276, 335; 73/118.1

[56] References Cited

U.S. PATENT DOCUMENTS

| | | | |
|---|---|---|---|
| 2,183,125 | 12/1939 | Riley et al. | 116/276 |
| 2,452,385 | 10/1948 | Merckel | 116/DIG. 41 |
| 2,815,328 | 12/1957 | Green | 252/75 |
| 2,972,581 | 2/1961 | Johnson | 252/75 |
| 3,361,547 | 1/1968 | Packo | 116/206 |
| 3,597,263 | 8/1971 | Bancroft et al. | 165/11.1 |
| 3,948,792 | 4/1976 | Watsen et al. | 252/181 |
| 4,682,493 | 7/1987 | Tenenbaum | 73/118.1 |

FOREIGN PATENT DOCUMENTS

| | | | |
|---|---|---|---|
| 0091046 | 10/1983 | European Pat. Off. | 116/335 |

*Primary Examiner*—Albert W. Davis, Jr.
*Assistant Examiner*—John K. Ford

[57] ABSTRACT

A water management system for heat exchange devices is disclosed which includes an aqueous based heat exchange liquid containing dissolved corrosion inhibitors and a fluorescent dye, conduit means adapted to circulate the heat exchange liquid between a source of heat, such as an engine, and a cooling device, such as a radiator, a liquid or solid concentrate containing measured amounts of the corrosion inhibitors and the fluorescent dye packaged in defined unit quantities, and a comparator calibrated to provide a visual indication of the concentration of the corrosion inhibitors in the liquid and, if the concentration falls below an established level, the number of units that must be added to restore the established level.

5 Claims, 1 Drawing Sheet

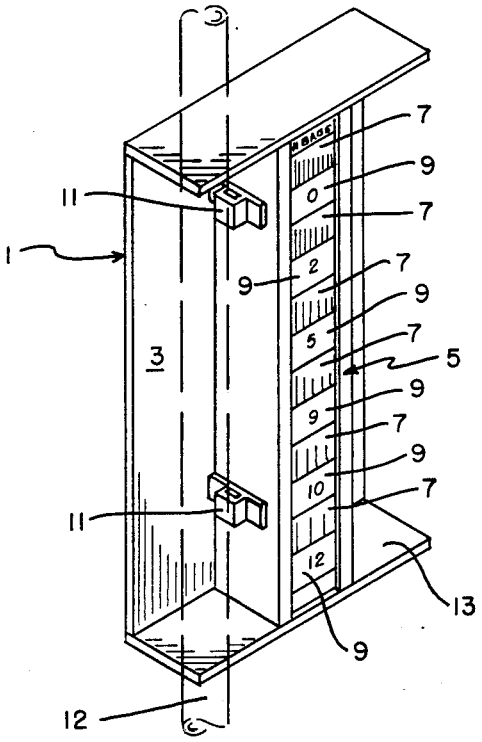
1
3
5
7
9
11
12
13
0
2
5
9
10
12

WATER MANAGEMENT SYSTEM

BACKGROUND OF THE INVENTION

With the demise of the steam locomotive and the advent of the diesel electric locomotive, the railroads found that dissolved minerals in the engine cooling water, such as calcium and silicates, caused corrosion and scale formation within the cooling system. For example radiators became clogged, cylinder liners were corroded, and the scale and corrosion deposits reduced the heat exchange efficiency of the cooling system. To avoid these problems, water treatment chemicals were formulated to reduce the corrosive effects of the dissolved minerals and ameliorate scale formation. The water treatment formulations that have proved most effective and have achieved wide acceptance are alkaline solutions containing borate and nitrite anions. Formulations of this type are fully disclosed, for example in U.S. Pat. Nos. 2,815,328, 2,972,581, and 3,948,792 the teachings of which are incorporated herein by reference.

While the prior art formulations are acceptable in their chemical performance, there is no convenient or reliable method by which the concentration of the treatment chemicals in the coolant water can be determined. Since make-up water must be added from time to time to compensate for inevitable coolant losses, the level of treatment chemicals may fall below desired levels or, in the alternative, treatment chemicals may be wasted by adding them in excessive amounts. Sometimes this problem has been addressed by adding a pH indicator, particularly phenolphthalein, to the treatment chemicals. Since the corrosion inhibitors are most effective in a pH range of from about 8.5 to 11 and they are formulated to adjust the coolant to that level, phenolphthalein will cause the coolant to change from red to colorless when the pH falls below 8 which can be observed, for example, through a sight glass. The use of phenolphthalein does not really solve the problem, however, since the pH must fall below the preferred level before any indication is given, since no indication is given if the treatment level is to high, and since the color intensity of the phenolphthalein diminishes with use in the environment.

OBJECTS OF THE INVENTION

Accordingly, it is an object of this invention to provide a reliable method by which the level of treatment chemicals can be visually observed.

Another object of this invention is to provide a reliable indication of the amount of treatment chemicals that must be added to the coolant to restore the desired level of treatment chemicals when they fall below desired levels.

A further object of this invention is to provide a visual indication of any leaks in the coolant system.

SUMMARY OF THE INVENTION

These and other objects of this invention are achieved through the use of a system that includes:

1. an aqueous based heat exchange liquid containing dissolved corrosion inhibitors and a fluorescent dye,
2. conduit means adapted to circulate the heat exchange liquid between a source of heat, such as an engine, and a cooling device, such as a radiator, 3. a liquid or solid concentrate containing measured amounts of the corrosion inhibitors and the fluorescent dye packaged in defined unit quantities, and
4. a comparator calibrated to provide a visual indication of the concentration of the corrosion inhibitors in the liquid and, if the concentration falls below an established level, the number of packaged units that must be added to restore the established level.

It should be understood that for brevity and clarity of description the invention is described herein with particular reference to cooling systems for diesel locomotives but it is not intended that the invention be so limited for it will also find utility in other closed cooling systems, such as in internal combustion engines, and open recirculating cooling systems such as those associated with large air conditioning systems.

BRIEF DESCRIPTION OF THE DRAWING

The FIGURE is a perspective view of a preferred optical comparator suitable for use in the system of this invention.

DETAILED DESCRIPTION OF THE INVENTION

The Treatment Chemicals

As mentioned above, the referenced patents disclose treatment chemicals of the type preferred for use in this invention. It is apparent from these patents that the amount and kind of the treatment chemicals can be varied with considerable latitude. However, the more common ingredients and the range in which they are added are summarized below. Attention is invited to the fact that the formulation of corrosion inhibitors is sometimes more art than science and the specific purposes given below for the addition of any specific chemicals may not be fully supportable. All amounts given below are as weight percentages of the dry ingredients.

| | |
|---|---|
| 1. Corrosion inhibitor for ferrous metals. | |
| Sodium nitrite | 5–50% |
| Sodium molybdate | 1–20% |
| 2. Buffer and corrosion inhibitor for aluminum and ferrous metals. | |
| Sodium metasilicate pentahydrate | 3–30% |
| Sodium metasilicate (anhydrous) | 3–30% |
| Sodium tetraborate pentahydrate | 9% |
| 3. Aluminum and ferrous metal corrosion inhibitor and solution stabilizer. | |
| Sodium nitrate | 2–40% |
| 4. Corrosion and oxidation inhibitor for cuprous metals. | |
| mercaptabenzathiozole | 1–2% |
| tolyltriazole | 1–2% |
| 5. Scale inhibitors. | |
| polyacrylic acid | 0.1% |
| aminomethylenetriphosphonic acid | 0.1% |
| 6. Alkali. | |
| Sodium hydroxide | Sufficient to provide pH 8.5–11 in coolant |

The Fluorescent Dye.

The selection of a proper dye for use in the system of this invention is of considerable importance. Among other considerations in the selection of a dye are that it be highly visible in small amounts, it should be non-staining, it should be non-toxic and non-polluting, and it should be fluorescent to make it simple, particularly under black light, to find and trace water leaks around the engine or in oil samples. Finally, the dye should be color stable in the coolant and compatible with anti-freeze compounds or other additives.

A dye meeting the above requirements which works well in the system of this invention is xanthene dye available under the trade designation INTRACID RHODAMINE which is a trademark of Crompton & Knowles. The dye is also described in U.S. Pat. No. 3,367,946. When added in an amount equal to 0.0.3 wt.% of the dry ingredients it imparts a highly visible pink color to the coolant and makes even minute quantities of the coolant visble under black light.

The Concentrate.

The concentrates useful in this invention are either in liquid or solid form and are packaged in measured amounts so that each package, or unit, has the same quantity of corrosion inhibiting chemicals and dye. When the packaged units contain solid chemicals, it is convenient to press the ingredients into large pills and enclose them in a water soluble package, such as made from polyvinyl alcohol.

The Comparator.

A comparator useful in the practice of this invention will provide the dual function of giving a colorimetric determination of the level of corrosion resistant chemicals in the coolant and providing a visual indication of the number of unit packages that must be added to the coolant to obtain the desired level of treatment chemicals in the system. These features can best be understood from the following description of the drawing.

A comparator 1 is shown in the FIGURE which generally comprises a back support plate 3 on which is mounted a color chip holder 5. The color chip holder 5 in turn supports a series of color chips 7 which, as here illustrated by the shaded lines, vary in color intensity from dark to light hues of the dye that is used in the system.

As illustrated in the FIGURE, the color chips 7 are spaced vertically to provide alternating spaces in which numeric values 9 may be inscribed. The color chips 7 are matched to the dye's concentration at various treatment levels and the numeric values 9 subjacent each chip 7 indicate the number of package units, such as bags, that must be added to the coolant to obtain the optimum concentration of treatment chemical It is convenient to provide chips 11 or other mounting devices which may be used to clip the comparator 1 along side a sight glass or to support a test tube holding a sample of the coolant.

The comparator 1 illustrated in the FIGURE has a base plate 13 which will support the comparator 1 when it is placed on a level surface. If the comparator 1 is mounted on a sight glass, the base plate 13 should not be used.

I claim:

1. A water management system for circulating water heat exchange devices comprising:

an aqueous based heat exchange liquid in which an effective level of dissolved corrosion inhibitors and fluorescent dye is established, conduit means through which the heat exchange liquid circulates between a source of heat and a cooling device a concentrate containing a fixed ratio of the corrosion inhibitors to the fluorescent dye which concentrate is packaged in defined unit quantities, and a comparator by which a visual colorimetric indication of the amount of the inhibitors and dyes in the system can be obtained and which comparator is calibrated to indicate the number of unit quantities that need be added, if any, to reestablish the effective level.

2. A system according to claim 1 in which the corrosion inhibitors are of the borate-nitrite type.

3. A system according to claim 2 in which the pH of the heat exchange liquid is adjusted to lie in a range of from 8.5 to 11.

4. A system according to claim 1 in which a series of color chips of various color intensity are mounted on the comparator for making a colorimetric determination of the concentration of the dissolved corrosion inhibitors.

5. A system according to claim 1 in which the fluorescent dye is xanthene.

* * * * *